US007325844B2

(12) United States Patent
Salice

(10) Patent No.: US 7,325,844 B2
(45) Date of Patent: Feb. 5, 2008

(54) OPENING AND CLOSING LATCH DEVICE FOR FURNITURE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/539,688

(22) PCT Filed: Oct. 14, 2004

(86) PCT No.: PCT/EP2004/052535

§ 371 (c)(1),
(2), (4) Date: Jun. 16, 2005

(87) PCT Pub. No.: WO2005/038177

PCT Pub. Date: Apr. 28, 2005

(65) Prior Publication Data

US 2006/0087128 A1 Apr. 27, 2006

(30) Foreign Application Priority Data

Oct. 15, 2003 (IT) ..... RM20030171 U

(51) Int. Cl.
*E05C 19/00* (2006.01)

(52) U.S. Cl. ..... 292/300; 292/302; 292/124; 292/130; 292/132; 292/170; 292/342

(58) Field of Classification Search ..... 292/300, 292/302 X, 121, 124 X, 128, 130 X, 131, 292/132 X, 136, 102, 106, 159, 169, 170 X, 292/342 X
See application file for complete search history.

(56) References Cited

U.S. PATENT DOCUMENTS 983,647 A * 2/1911 Romines ..... 292/111
1,859,003 A * 5/1932 Ragan ..... 220/724
2,670,981 A * 3/1954 Wenham ..... 292/114
4,383,707 A * 5/1983 Nishimura ..... 292/110
4,616,861 A * 10/1986 Kurosaki ..... 292/6
4,660,871 A * 4/1987 Arakawa et al. ..... 292/81
4,792,165 A * 12/1988 Nishimura ..... 292/19
5,072,974 A 12/1991 Henne et al.
5,401,067 A 3/1995 Kurosaki et al.
5,518,282 A * 5/1996 Sawada ..... 292/252
5,984,381 A * 11/1999 Yamagishi ..... 292/45
6,068,307 A * 5/2000 Murphy ..... 292/302
6,357,803 B1 * 3/2002 Lorek ..... 292/99
6,588,809 B1 * 7/2003 Derman ..... 292/129
6,659,514 B2 * 12/2003 Bass ..... 292/122

FOREIGN PATENT DOCUMENTS

DE 197 53 319 A1 7/1998
EP 0 766 939 A 4/1997

* cited by examiner

*Primary Examiner*—Jennifer H. Gay
*Assistant Examiner*—Mark Williams
(74) *Attorney, Agent, or Firm*—Nixon Peabody LLP

(57) ABSTRACT

Latch device composed of a container (51) in which there is a slider (52), inserted in a guide (60), controlled in translation by a spring (53) and comprising a hook (68) to catch a hooking element (59) placed on a door. A track (40), with the bottom defining the profile of a cam on one side of the guide (60), is travelled along by a ball (73) placed on the slider (52) and held pressed by a spring (72) against the bottom of the track (40) to determine the four open, closed, released and locked positions of the door according to the position of the ball in the track.

6 Claims, 4 Drawing Sheets

OPENING AND CLOSING LATCH DEVICE FOR FURNITURE

FIELD OF THE INVENTION

The present invention relates to an opening and closing device for furniture provided with a latch adapted to facilitate operations to open and close movable parts of furniture, for brevity also called latch.

STATE OF THE ART

Known latches have the function of facilitating opening or closing of the doors of furniture or drawers, according to the application for which they have been designed. These latches produce a slight contrasting force during the closing action that is accumulated by elastic elements capable of releasing it in a subsequent phase when the reverse operation of opening is implemented.

If a latch is used to facilitate opening of a drawer or door, the latter is maintained in its closed position by suitable and known devices, which can either be separate from the latch or integral with it, for example hooks, magnets or the like.

To open the drawer or door it is first necessary to apply a slight thrust to the drawer or door to release the latch, which returns the elastic energy accumulated during the closing operation and exerts a force on the drawer, generally created by springs, in the opening direction. An advantage of these devices is that they also make it possible not to use handles or other similar grasping elements on the drawer, which are not always appreciated for aesthetic or other reasons.

Generally, one part of the elements constituting the latches is placed on fixed elements of the furniture to which the drawer belongs and another part on the drawer itself; moreover, these are constituted by a large number of elements that can make assembly by inexperienced personnel difficult.

Some known latches are described in the documents DE 29507917U, DE 3816091, DE 19753319 and DE 10008350. However, these are devices that are complex to manufacture or to mount, some of which are too delicate to guarantee long-lasting operation.

SUMMARY OF THE INVENTION

A main purpose of the present invention is therefore to produce a latch that overcomes the drawbacks indicated hereinbefore in a simple and inexpensive way and which is compact, sturdy and easy to apply to furniture, particularly to doors. Therefore, the present invention solves the problems mentioned hereinbefore by producing a latch with the characteristics claimed in claim 1.

In particular, the invention relates to a latch device, which can be locked and released by the action of an external force produced by one or more springs, comprising a slider. The slider is suitable to translate along a guide, integral with a fixed part of the furniture, inclined by an angle differing from zero with respect to the direction in which the external closing force is applied, and has a hook that may be caught by the movable part of the furniture. Moreover, elements suitable to lock or to release the slider according to the function implemented are provided between the slider and the container.

Thanks to the solution of the invention, the latch has a simple and compact structure that can be applied simply to drawers or doors of furniture, thus guaranteeing exact positioning with respect to the parts and consequently its correct operation. It is also characterized by fast and easy mounting that can be performed without the use of special tools.

The latch device is also sturdy and secure against any danger of becoming detached from the furniture element to which it is fixed. The latch also has compression springs or equivalent elastic means capable of controlling sufficient opening travel to allow easy manual grip to complete opening of the drawer or, if necessary, even to completely eliminate this action.

The dependent claims describe preferred embodiments of the invention.

BRIEF DESCRIPTION OF THE FIGURES

Further characteristics and advantages of the invention shall become more evident in the light of the detailed description of preferred, although not exclusive, embodiments of a latch, provided as non-limiting examples, with the aid of the accompanying drawings, wherein.

DETAILED DESCRIPTION OF PREFERRED EMBODIMENTS

Figure 1:
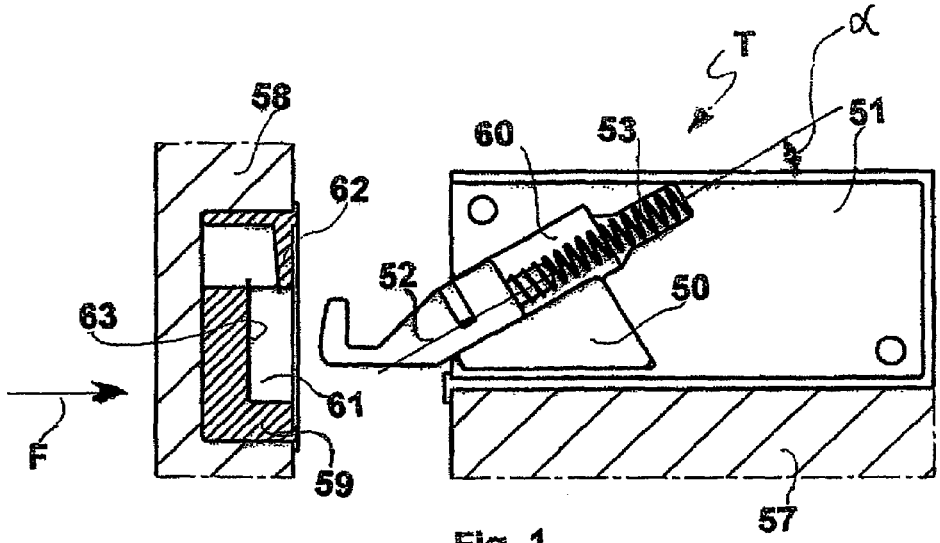
FIG. 1 shows a side view of the latch device of the invention in a first operating position.

With reference to the Figures cited, a latch device is represented, globally referenced with the reference T, generally, although not necessarily, fixed in one part thereof to a suitable structure of furniture 57, and in another part thereof to a door 58. It is however possible to kinetically invert the furniture parts on which the two parts forming the latch are fixed, however without departing from the sphere of the invention.

The part of the latch T destined to be fixed to the furniture 57 with suitable means that are not described in detail, comprises a box or container 51 with a first groove or longitudinal cavity defining a sliding guide 60. In the guide 60 there are the slider 52, the helical spring 53 or another similar spring, which rests with one end on a shoulder or end of the guide and with the other end on the slider 52, on which a shank 65 is provided to improve contact with the spring 53. The container 51 has a cover 54 to close the open side of the guide 60.

In an advantageous embodiment part of the container is provided with an insert 50 essentially triangular in shape, which forms one side of the guide 60, or part of one side, to facilitate manufacture and assembly. However, the insert 50 may alternatively also be eliminated to produce the container 51 in one piece.

The guide 60 is inclined, with respect to the direction of application of the force F acting on the slider 52, of an angle $\alpha$, predetermined and defined according to the door or furniture part to be opened.

There is provided, on the side of the guide 60, a second groove defining a track 40 with different depths according to areas defining a path with a cam profile.

The slider 52 also has a seat 71 with a rectangular plane, closed on the bottom, in which is placed a flat spring 72 bent in the shape of a V, on the outward facing side of which a ball 73 rests. The flat spring 72 thus pushes the ball 73 towards the bottom of the track 40 to make it travel along the path. A third groove 67 facilitates attachment of the spring 72 in its seat 71.

The track 40 is constituted by a longer longitudinal section 27, the bottom of which varies in thickness and forms an inclined ramp terminating with a step 28, which marks the limit separating it from a transverse section 29 slightly curved in the plane. The bottom of the transverse section 29 has two sections with levels 29', 29" slightly staggered, in the deepest of which 29" a seat 30 is provided in the shape of a spherical cap. Running parallel to the section 27 is a second shorter longitudinal section 31, which joins with the front part of the section 27 by means of a section 32, the bottom of which is inclined, and at the end of which a short inclined ramp 33 is positioned to form a further step 34 in the connection point with the section 27.

Figure 8:
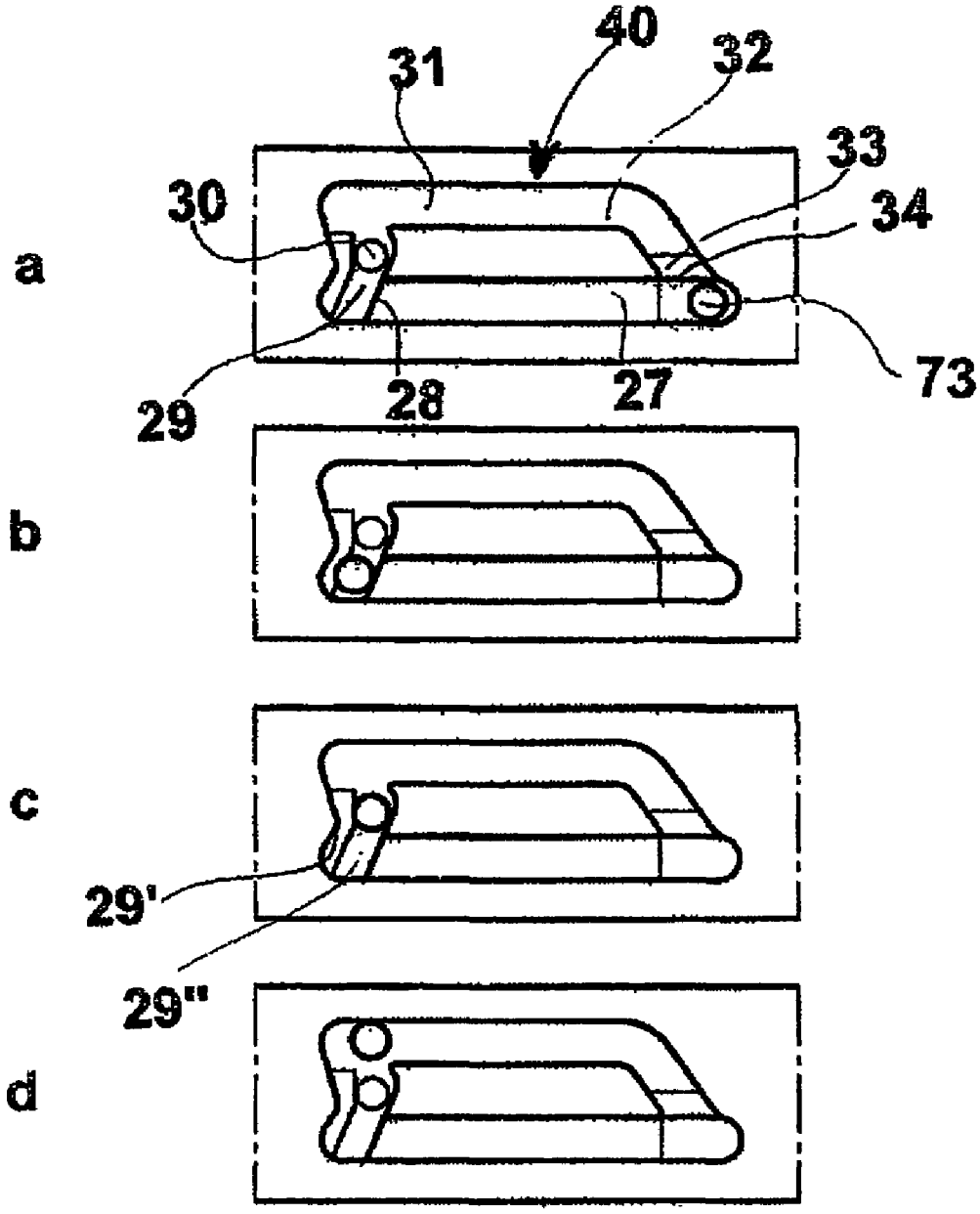
FIG. 8 shows four different operating phases of the latch according to the invention.

FIG. 8 shows four positions of the latch, which show its operation between an open position and a locked position and again in an open position. The positions are indicated with the letters a), b), c), d) and also define four corresponding positions of the ball 73 along the track of the cover. Here the positions are shown as transparency views through the surface of the insert 50. In position a) the hook 68 is in the outermost position, and therefore the hooking element 59 and the door connected to it can move freely. When the door 58 is pushed towards the closing position, the hooking element 59 knocks against the hook 68 with a force F, the component thereof parallel to the axis of the guide 60 pushes the slider 52 inside the guide 60 compressing the spring 53 to reach the position shown in FIG. 2.

During this sliding, the hook 68 engages the hooking edge 62 of the hooking element 59, catching it. At this point as the ball 73 cannot travel along the section 32 as it is obstructed by the step 34, it travels along the ramp 27 and passes beyond the step 28. Here inclination of the shank of the V-shaped spring 72 pushes the ball 73 along the deepest part 29" of the section 29 until it enters the seat 30 in the form of spherical cap, becoming locked in the position c). In this position the slider 52 cannot slide in the groove and the hook 68 locks the hooking element 59, so that the furniture part remains locked in its closed position even if no external force is applied thereto.

The operation to open the door or drawer is instead carried out in the following way. After a successive slight thrust in the closing direction of the door, the ball 73 is moved from the seat 30 towards the shallowest part 29' of the section 29 and the spring 72 pushes it into the position d). By removing the external force on the furniture part, the helical spring 53 pushes the slider 52 towards the outside and the ball 73 travels along the sections 31 and 32 passing beyond the ramp 33 and the step 34, returning to the initial condition a) wherein the furniture part is released.

Figure 2:
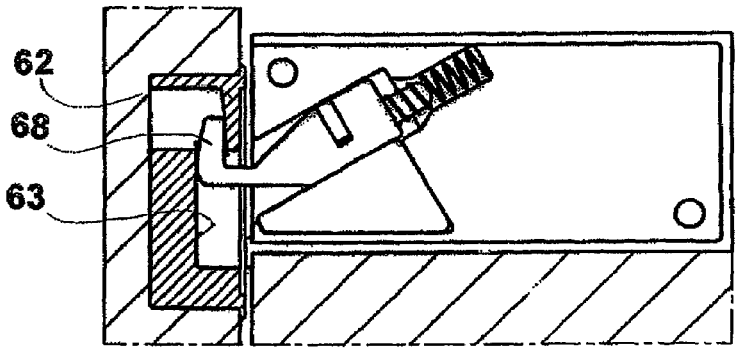
FIG. 2 shows a side view of the latch device in FIG. 1 in a second operating position.
Figure 3:
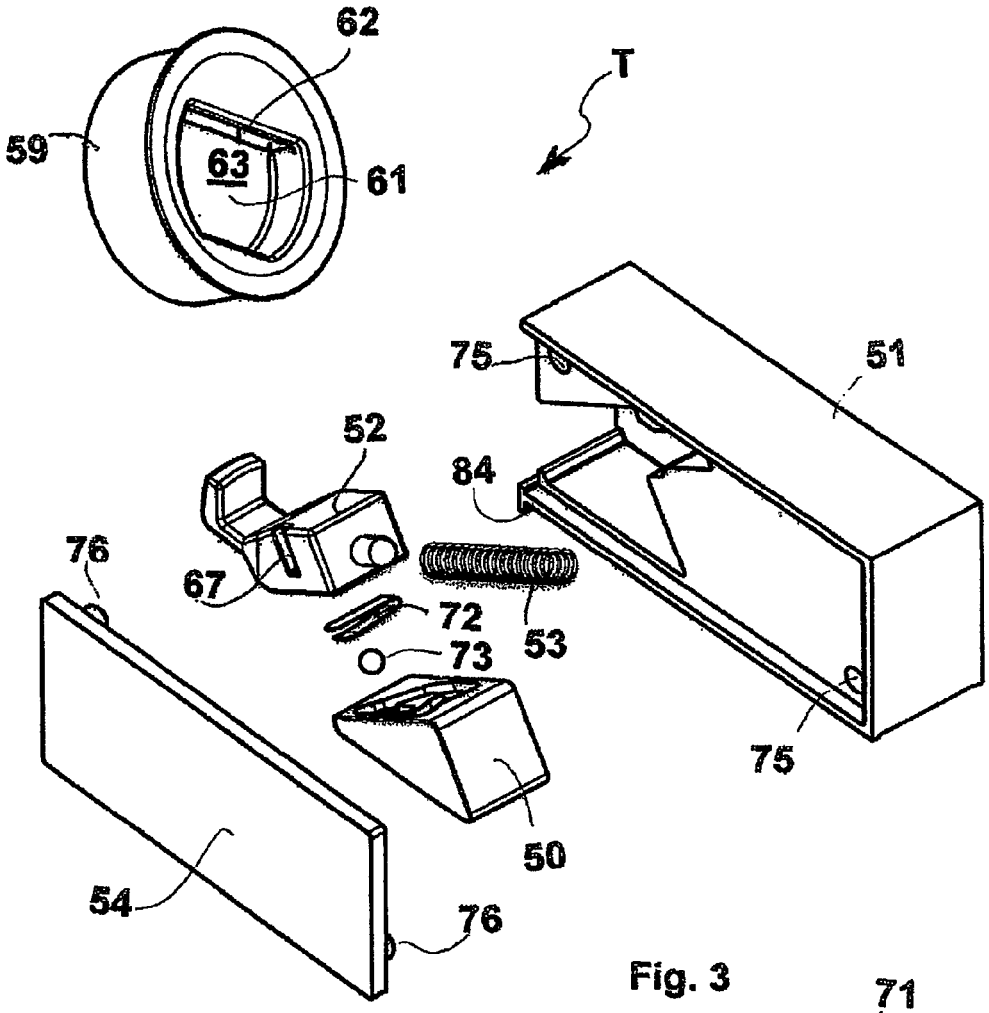
FIG. 3 shows an exploded axonometric view of the latch device in FIG. 1.
Figure 4:
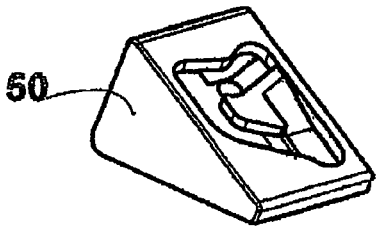
FIG. 4 shows an axonometric view of an element forming the latch device in FIG. 1.
Figure 5:
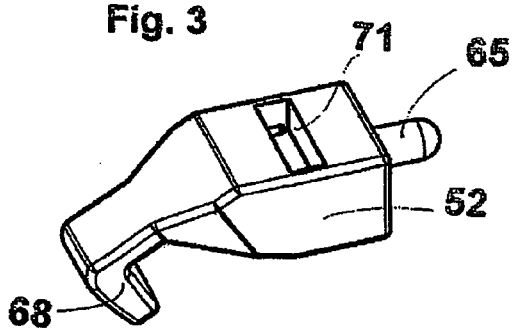
FIG. 5 shows an axonometric view of an element forming the latch device in FIG. 1.

Advantageously, the hooking element can be constituted by a cavity 61 partly open towards the opposed flat surfaces so as to easily produce the hooking edge 62, even with a molding process. The bottom 63 constitutes the thrust element of the hook 68 when the latch is in operation, making it slide in combination with the oblique movement in the inclined direction of the angle $\alpha$, until it is positioned behind the hooking edge 62, as shown in FIGS. 2 and 6.

The cover 54 is also provided with shanks 76 suitable to be housed in corresponding holes 75 of the container 51 to allow integral assembly of the two parts.

Figure 6:
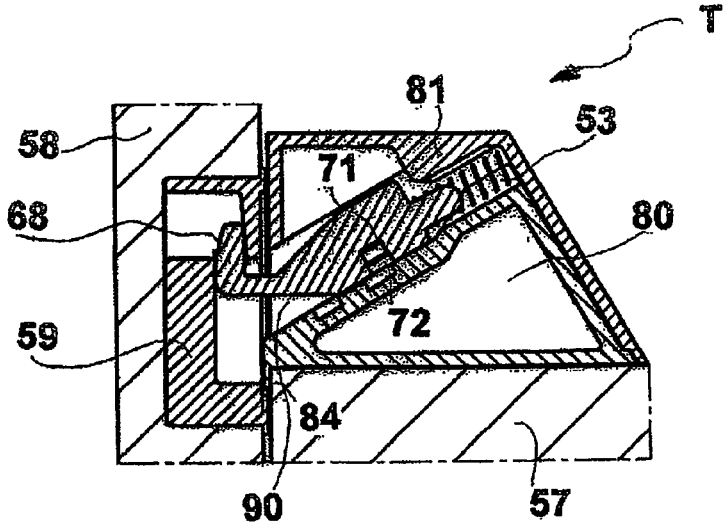
FIG. 6 shows a side section of an embodiment of the latch device of the invention.
Figure 7:
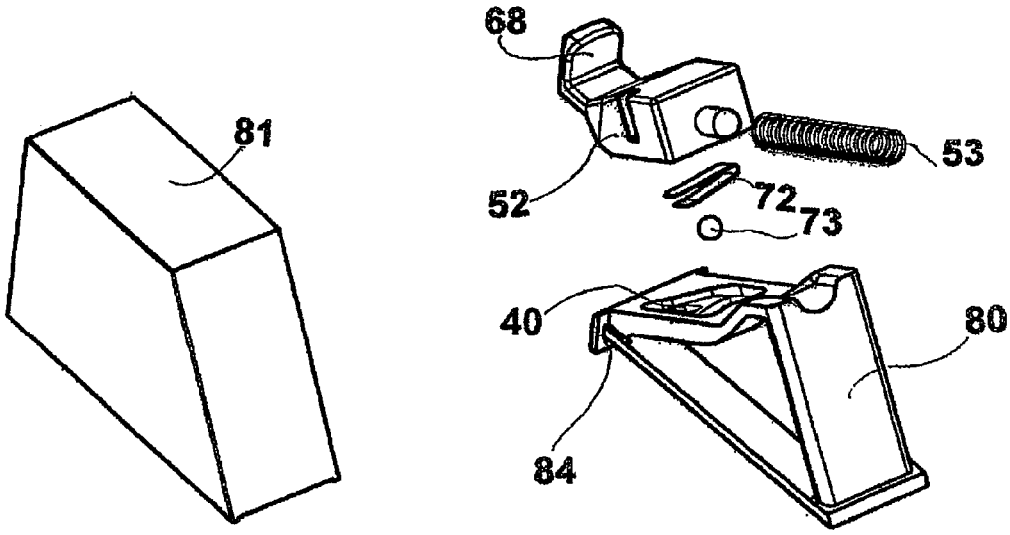
FIG. 7 shows an exploded axonometric view of the latch device in FIG. 6.

An embodiment of the latch conforming to the invention is shown in FIGS. 6 and 7. The container 81 has an essentially hollow trapezoidal shape inside which a sliding guide 90 is placed. One of the sides of the container is open and, in the mounted position of the latch, this side is closed by a triangular insert 80, one of the sides thereof defining a side of the guide 90. The triangular insert 80 also has the function of resting on the furniture, with a suitable reference stop 84. Advantageously, although not necessarily, the track 40 can be provided on one side of the triangular insert 80. This element is suitably fixed to the container 81 by means of fixing means of known type, not shown.

From the description above it is apparent that the latch device of the invention is composed of a minimum number of components, is simple to assemble and can be mounted on furniture with an operation that is not difficult even for inexperienced personnel.

The particular embodiments described herein do not limit the content of this application, which covers all the embodiments of the invention defined by the claims.

The invention claimed is:

1. Opening and closing latch device, adapted to facilitate closing and/or opening of a movable part of furniture with respect to the furniture, comprising:

a container defining an internal cavity with at least one open side;

a sliding guide;

a sliding element, placed in the sliding guide and comprising a rigid hook at a first end, suitable to catch a hooking element integral with said movable part, an elastic device, placed between the sliding element and the container, so that the elastic device exert an elastic force on the sliding element suitable to make it slide, reacting on said container, a track, placed on one side of the sliding guide, with surface of the bottom defining a cam path, a tappet device, integral with the sliding element, suitable to travel along the cam path, so as to define a number of positions of the sliding element, corresponding to a release position, a lock position and two intermediate opening and closing positions of said movable part, wherein substantially all of the sliding guide is inclined of an angle ($\alpha$) with respect to the direction along which a closing and opening movement takes place between the movable part and the furniture.

2. Latch device according the claim 1, wherein the container comprises an insert substantially triangular in shape, one side of which defines a side of the sliding guide.

3. Latch device according the claim 2, wherein the track is provided on the side of the sliding guide constituted by said insert.

4. Latch device according the claim 3, wherein the container comprises a cover, forming one of the sides of the cavity, and a base with a connection device suitable to join the cover to the base.

5. Opening and closing latch device, adapted to facilitate closing and/or opening of a movable part of furniture with respect to the furniture, comprising:

a container defining an internal cavity with at least one open side;

a sliding guide;

a sliding element, placed in the sliding guide and comprising a rigid hook at a first end, suitable to catch a hooking element integral with said movable part;

an elastic device, placed between the sliding element and the container, so that the elastic device exert an elastic force on the sliding element suitable to make it slide, reacting on said container;

a track, placed on one side of the sliding guide, with surface of the bottom defining a cam path;

a tappet device, integral with the sliding element, suitable to travel along the cam path, so as to define a number of positions of the sliding element, corresponding to a release position, a lock position and two intermediate opening and closing positions of said movable part;

wherein the sliding guide is inclined of an angle ($\alpha$) with respect to the direction along which a closing and opening movement takes place between the movable part and the furniture;

wherein the container comprises an insert substantially triangular in shape, one side of which defines a side of the sliding guide;

wherein the track is provided on the side of the sliding guide constituted by said insert;

wherein the container comprises a cover, forming one of the sides of the cavity, and a base with a connection device suitable to join the cover to the base;

wherein the tappet device is formed of a ball held in pressure against the bottom of the track by a spring.

6. A latch device comprising:

a container defining an internal cavity with at least one open side;

a sliding guide inclined of an angle ($\alpha$) with respect to the direction along which a closing and opening movement takes place between the movable part and the furniture;

a sliding element, placed in the sliding guide and comprising a substantially rigid hook at a first end, suitable to catch a hooking element integral with said movable part, an elastic device, placed between the sliding element and the container, so that the elastic device exert an elastic force on the sliding element suitable to make it slide, reacting on said container, a track, placed on one side of the sliding guide, with a surface defining a cam path; and a tappet device, integral with the sliding element, suitable to travel along the cam path defining positions of the sliding element comprising a release position, a lock position and one or more intermediate opening and closing positions of the movable part, wherein the tappet device is formed of a ball held in pressure against the track by a spring.

* * * * *